US010494170B2

(12) United States Patent
Polacek et al.

(10) Patent No.: US 10,494,170 B2
(45) **Date of Patent: *Dec. 3, 2019**

(54) PORTABLE VERTICAL FLUID STORAGE TANK

(71) Applicant: JWF Industries, Johnstown, PA (US)

(72) Inventors: William C. Polacek, Johnstown, PA (US); Marc J. Speciale, Johnstown, PA (US); Matthew J. Hughes, Davidsville, PA (US)

(73) Assignee: JWF Industries, Johnstown, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/267,021

(22) Filed: Feb. 4, 2019

(65) Prior Publication Data

US 2019/0168957 A1 Jun. 6, 2019

Related U.S. Application Data

(63) Continuation of application No. 14/703,272, filed on May 4, 2015, now Pat. No. 10,202,236.
(Continued)

(51) Int. Cl.
*B65D 88/02* (2006.01)
*F15D 1/00* (2006.01)
(Continued)

(52) U.S. Cl.
CPC ..... *B65D 88/022* (2013.01); *B65D 88/128* (2013.01); *B65D 88/72* (2013.01); *B65D 88/741* (2013.01); *B65D 90/02* (2013.01); *B65D 90/024* (2013.01); *B65D 90/10* (2013.01); *B65D 90/12* (2013.01); *B65D 90/48* (2013.01);
(Continued)

(58) Field of Classification Search
CPC ..... B65D 88/027; B65D 88/08; B65D 88/12; B65D 88/128–129; B65D 90/0033; B65D 90/24; B65D 2590/0091; F17C 2201/035; F17C 2223/0153
USPC ..... 220/1.5, 560.03, 562, 565, 571; 137/1, 137/382, 395–396, 590; 222/103, 221,
(Continued)

(56) References Cited

U.S. PATENT DOCUMENTS

D162,118 S 2/1951 Bausenbach
2,920,784 A 1/1960 Boardman
(Continued)

OTHER PUBLICATIONS

Photo and Product Sheet of Redneck Oilfield Rentals 400 bbl Tank, http://www.redneckoilfield.ca/tanks.html, 2 pages.
(Continued)

*Primary Examiner* — Chun Hoi Cheung
*Assistant Examiner* — Brijesh V. Patel
(74) *Attorney, Agent, or Firm* — The Webb Law Firm

(57) ABSTRACT

A vertical fluid storage tank including a body extending from a first end to a second end and including a substantially oval-shaped cross-section, a top wall connected to the first end of the body, a bottom wall connected to the second end of the body, at least one access opening positioned on the top wall configured for access to an interior cavity of the body, and at least one discharge valve connected to the body. The storage tank is configured to be arranged in at least two positions. The at least two positions include a first position in which the storage tank is arranged parallel to a surface, and a second position in which the storage tank is arranged perpendicular to the surface. A walkway may be positioned in the interior cavity of the body.

20 Claims, 13 Drawing Sheets

Related U.S. Application Data

(60) Provisional application No. 61/989,236, filed on May 6, 2014.

(51) Int. Cl.

| | |
|---|---|
| ***B65D 88/72*** | (2006.01) |
| ***B65D 90/02*** | (2019.01) |
| ***B65D 90/10*** | (2006.01) |
| ***B65D 90/12*** | (2006.01) |
| ***B65D 90/48*** | (2006.01) |
| ***B65D 88/12*** | (2006.01) |
| ***B65D 88/74*** | (2006.01) |

(52) U.S. Cl.
CPC ..... *F15D 1/0015* (2013.01); *F15D 1/0065* (2013.01); *B65D 2590/0091* (2013.01); *Y10T 137/85954* (2015.04)

(58) Field of Classification Search
USPC ..... 222/235, 413, 459; 280/414.5, 830, 837, 280/839
See application file for complete search history.

(56) References Cited

U.S. PATENT DOCUMENTS

| | | | |
|---|---|---|---|
| 3,160,171 | A | 12/1964 | Klein |
| D201,477 | S | 6/1965 | Mowatt-Larssen et al. |
| 3,339,499 | A | 9/1967 | Charles et al. |
| 3,570,705 | A | 3/1971 | Yazdani |
| 3,583,331 | A | 6/1971 | Mowatt-Larssen |
| 3,638,699 | A | 2/1972 | Hillinger |
| 3,680,275 | A | 8/1972 | Romlet et al. |
| 3,834,576 | A | 9/1974 | Heisterberg |
| D243,455 | S | 2/1977 | Verini |
| 4,100,610 | A | 7/1978 | Johnston et al. |
| 4,318,549 | A | 3/1982 | Pletcher |
| 4,348,962 | A | 9/1982 | Smith |
| 4,374,478 | A | 2/1983 | Secord et al. |
| 4,406,471 | A | 9/1983 | Holloway |
| 4,474,254 | A | 10/1984 | Etter et al. |
| D278,457 | S | 4/1985 | Schroder et al. |
| D279,921 | S | 7/1985 | Blumer et al. |
| 4,589,565 | A | 5/1986 | Spivey |
| 4,615,453 | A | 10/1986 | Taquoi |
| 4,655,367 | A | 4/1987 | Palazzo |
| 4,696,238 | A | 9/1987 | Billingsley, Jr. et al. |
| D301,326 | S | 5/1989 | Adams |
| 4,838,703 | A | 6/1989 | McMaster et al. |
| 4,939,833 | A | 7/1990 | Thomas |
| 4,960,222 | A | 10/1990 | Fields, III |
| 5,055,204 | A | 10/1991 | Bogart |
| 5,082,416 | A | 1/1992 | Bock |
| 5,083,673 | A | 1/1992 | Fossey |
| 5,096,007 | A | 3/1992 | Burkhard |
| 5,129,540 | A | 7/1992 | Palazzo |
| 5,188,252 | A | 2/1993 | Gerhard |
| RE34,203 | E | 3/1993 | Palazzo |
| 5,198,398 | A | 3/1993 | van Duijn |
| 5,273,180 | A | 12/1993 | Whatley, Jr. |
| D353,352 | S | 12/1994 | Holloway, Jr. |
| 5,390,806 | A | 2/1995 | Elston et al. |
| D375,470 | S | 11/1996 | Adams |
| D378,810 | S | 4/1997 | Norman, Jr. et al. |
| 5,647,514 | A | 7/1997 | Toth et al. |
| 5,671,855 | A | 9/1997 | Norman, Jr. et al. |
| D384,913 | S | 10/1997 | Norman, Jr. et al. |
| 5,695,089 | A | 12/1997 | Reese et al. |
| 5,779,077 | A | 7/1998 | Fossey |
| 5,787,920 | A | 8/1998 | Krasnov |
| D412,962 | S | 8/1999 | Riley |
| 5,960,826 | A | 10/1999 | Hebblethwaite et al. |
| D417,171 | S | 11/1999 | Satterfield et al. |
| 5,996,827 | A | 12/1999 | Splane |
| 6,079,580 | A | 6/2000 | Garton et al. |
| 6,199,910 | B1 | 3/2001 | Wade |
| D441,692 | S | 5/2001 | Niblett et al. |
| 6,279,955 | B1 | 8/2001 | Fisher |
| 6,375,222 | B1 | 4/2002 | Wade |
| 6,390,325 | B1 | 5/2002 | Gonzales |
| 6,464,094 | B2 | 10/2002 | Zacharias |
| 6,726,409 | B1 | 4/2004 | Yielding et al. |
| 7,104,425 | B2 | 9/2006 | Le Roy |
| RE39,721 | E | 7/2007 | Garton |
| 7,252,429 | B2 | 8/2007 | Yungblut |
| D557,178 | S | 12/2007 | Petzitillo, Jr. et al. |
| D637,114 | S | 5/2011 | Ries |
| 7,997,623 | B2 | 8/2011 | Williams |
| D653,587 | S | 2/2012 | Haut et al. |
| 8,215,516 | B2 | 7/2012 | Kaupp |
| 8,366,312 | B1 | 2/2013 | Valdez et al. |
| 8,590,720 | B2 | 11/2013 | Thomas, II |
| 2002/0166861 | A1 | 11/2002 | Hinkle et al. |
| 2006/0096991 | A1 | 5/2006 | Schmidt et al. |
| 2007/0056975 | A1 | 3/2007 | Long et al. |
| 2008/0087665 | A1 | 4/2008 | Rummel |
| 2009/0134171 | A1 | 5/2009 | deBerardinis |
| 2010/0032435 | A1 | 2/2010 | Satterfield et al. |
| 2010/0122988 | A1 | 5/2010 | Clanton |
| 2010/0320727 | A1 | 12/2010 | Haut et al. |
| 2011/0006068 | A1 | 1/2011 | Kaupp |
| 2011/0109073 | A1 | 5/2011 | Williams |
| 2011/0121555 | A1 | 5/2011 | Anderson |
| 2011/0186581 | A1 | 8/2011 | Ries |
| 2011/0211818 | A1 | 9/2011 | Grady |
| 2012/0024738 | A1 | 2/2012 | Herman et al. |
| 2012/0134772 | A1 | 5/2012 | Herman et al. |
| 2012/0199508 | A1 | 8/2012 | Hebblethwaite |
| 2013/0284751 | A1 | 10/2013 | Rund |
| 2014/0096832 | A1 | 4/2014 | Thiessen |

OTHER PUBLICATIONS

Photo of Wrangler Rentals Tank, 1 page.
Photos and Product Sheet of Crown Tank Infinity Tank, http://dev.crowntank.com/wp-content/uploads/2014/01/infinity.pdf, 2 pages.
Photo and Product Sheets of Pro-Find Equipment, Inc. 400 bbl Single Wall Tank, http://www.profindequipmentinc.com/Tank-details2.html, Feb. 16, 2012, 6 pages.
Product Sheet of TNT Energy Services, Ltd. 400 bbl Upright Tank, http://tntenergy.ca/400-bbl-uprights/, Oct. 14, 2011, 1 page.
Product Sheet of Wylie Oilfield Rentals 400 bbl Production Tank, http://allisonchampagne.com/wylie/wp-content/uploads/2013/09/400-Bbl-Production-Tank.pdf, Sep. 26, 2011, 1 page.
Product Sheet of Wylie Oilfield Rentals 400 bbl Heated and Insulated Production Tank, http://allisonchampagne.com/wylie/wp-content/uploads/2013/09/400-Bbl-Heated-Insulated-Production-Tank.pdf, Dec. 3, 2012, 1 page.
Photo and Product Sheet of Revcon 400 bbl Storage Tank, http://revcon.ca/what-we-do/rentals/400bbl-tanks, Jan. 15, 2011, 5 pages.
Photos and Product Sheet of Advanced Fluid Containment, LLC 400 bbl Round Skidded Tank, http://afctanks.com/products/skidded-tanks.html, Apr. 2, 2012, 6 pages.
Photos and Product Sheet of Strad 400 bbl Tank, http://www.stradenergy.com/Our-Solutions/Surface-Equipment/8/400-BBL-Tanks, Aug. 18, 2012, 2 pages.

PORTABLE VERTICAL FLUID STORAGE TANK

CROSS REFERENCE TO RELATED APPLICATION

This application is a continuation of U.S. patent application Ser. No. 14/703,272, filed May 4, 2015 and now issued as U.S. Pat. No. 10,202,236, which claims the benefit of U.S. Provisional Patent Application No. 61/989,236, filed May 6, 2014, the disclosures of all of which are incorporated herein by reference in their entireties.

BACKGROUND OF THE INVENTION

Field of the Invention

This disclosure relates generally to fluid storage tanks and, more particularly, to an oval-shaped, vertical fluid storage tank.

Description of Related Art

Portable fluid storage tanks used to store well fracturing fluids are well known in the art. Current pre-exiting storage tanks include trailer tanks and skidded tanks. The trailer tanks are sized, shaped, and oriented similar to the tank of a semi-tractor trailer and include a rear axle with wheels for transportation. These trailer tanks are typically transported to a worksite via a semi-tractor trailer and parked together with additional trailer tanks for storage of the worksite's fracturing fluids. The fracturing fluid is pumped from the trailer tanks and is used for the fracturing of the worksite. After the trailer tank has been depleted, the trailer tank is transported from the worksite back to a filling station to refill the tank. These trailer tanks are typically positioned in a horizontal direction relative to the ground of the worksite. One example of such a trailer tank is shown in U.S. Pat. No. 8,215,516 to Kaupp.

The pre-existing skid tanks are generally cylindrical with skids welded to a side surface of the tank. The skid tanks are transported to the worksite in a similar manner as trailer tanks. The skid tanks are loaded onto a trailer of a semi-tractor trailer and transported to the worksite. Upon delivering the skid tanks to the worksite, the skid tank is lifted into a vertical position using chains or cables pulled by winches or a suitable vehicle. The semi-tractor trailer may also include a mechanism for tipping the skid tank off of the trailer and into a vertical position. The pre-existing fluid storage tanks each have advantages and disadvantages for use at worksites. Trailer tanks typically have a low profile but require a large storage space area at the worksite due to the horizontal length of each trailer tank. Skid tanks typically require less room for storage at the worksite, but require additional handling and care for placing each skid tank in a vertical position. Further, extra equipment is usually needed to put the skid tank in a vertical position.

When fracturing a gas well in a shale formation, for example, a very large amount of fracturing fluid is necessary for performing the operation. Due to economic considerations, the well is typically fractured in a single, uninterrupted procedure. Equipment rental costs and labor costs are often increased if the fracturing procedure needs to be terminated due to a lack of fracturing fluid. Therefore, it is often necessary to ensure that the proper amount of fracturing fluid is provided at the worksite before starting the fracturing procedure. In situations where a lengthy and long fracture is necessary, a large volume of fracturing fluid is required. This in turn necessitates the use of a large number of fluid storage tanks to hold the requisite amount of fracturing fluid. It is therefore desirable to house the largest amount of fracturing fluid in the smallest area of worksite space possible.

SUMMARY OF THE INVENTION

There exists a current need for a fluid storage tank that occupies a small amount of area while providing a large amount of fracturing fluid. There also exists a need for a fluid storage tank that is easily transported to the worksite and easily arranged at the worksite.

It is therefore an object of this invention to provide a fluid storage tank that has a small footprint to provide a maximum amount of fluid storage at a worksite.

In one aspect of the disclosure, a vertical fluid storage tank includes a body extending from a first end to a second end and including a substantially oval-shaped cross-section, a top wall connected to the first end of the body, a bottom wall connected to the second end of the body, at least one access opening positioned on the top wall configured for access to an interior cavity of the body, and at least one discharge valve connected to the body. The storage tank is configured to be arranged in at least two positions. The at least two positions include a first position in which the storage tank is arranged parallel to a surface and a second position in which the storage tank is arranged perpendicular to the surface.

A walkway may be positioned in the interior cavity of the body. A ladder may be connected to the top wall of the body. At least one stiffening ring may be positioned in the interior cavity of the body. At least one tension member may be positioned in the interior cavity of the body. At least one compression member may be positioned in the interior cavity of the body. A fluid indicator may be provided including a first end attached to an exterior surface of the body and a second end inserted into the interior cavity of the body. The fluid indicator may be configured to measure a volume of fluid that may be stored in the body. A fluid circulating arrangement may be provided in the interior cavity of the body and may include a main supply member, an inlet member in fluid communication with the main supply member, and at least one discharge member in fluid communication with the main supply member. The fluid circulating arrangement is configured to circulate fluid within the fluid storage tank. The at least one discharge member may include at least two discharge members spaced along a longitudinal length of the main supply member. The at least two discharge members may be positioned at an angle from one another on the main supply member. Fluid may be drawn out of the fluid storage tank using an external pump and the same fluid may be supplied to the inlet member of the fluid circulating arrangement using the external pump.

According to another aspect of the disclosure, a vertical fluid storage tank arrangement may include a body extending from a first end to a second end and including a substantially oval-shaped cross-section, a top wall connected to the first end of the body, a bottom wall connected to the second end of the body, and a frame member connected to an exterior surface of the body. The storage tank may be configured to be arranged in at least two positions. The at least two positions may include a first position in which the storage tank is arranged parallel to a surface and a second position in which the storage tank is arranged perpendicular to the surface.

The frame member may include a ladder extending in a longitudinal direction relative to the body. The frame member may include a walkway extending across the top wall of the storage tank. A walkway may be positioned in the interior cavity of the body. The frame member may be substantially L-shaped including a first portion that extends along the longitudinal length of the body and a second portion that extends along the top wall of the storage tank.

In another aspect of the disclosure, a fluid circulating arrangement for a fluid storage tank includes a main supply member, an inlet member in fluid communication with the main supply member, and at least one discharge member in fluid communication with the main supply member. The fluid circulating arrangement may be configured to circulate fluid within the fluid storage tank. The at least one discharge member may include at least two discharge members spaced along a longitudinal length of the main supply member. The at least two discharge members may be positioned at an angle from one another on the main supply member. Fluid may be drawn out of the fluid storage tank using an external pump and the same fluid may be supplied to the inlet member using the external pump.

Further details and advantages will be understood from the following detailed description read in conjunction with the accompanying drawings.

DESCRIPTION OF THE PREFERRED EMBODIMENTS

For purposes of the description hereinafter, spatial orientation terms, as used, shall relate to the referenced aspect as it is oriented in the accompanying drawings, figures, or otherwise described in the following detailed description. However, it is to be understood that the aspects described hereinafter may assume many alternative variations and configurations. It is also to be understood that the specific components, devices, features, and operational sequences illustrated in the accompanying drawings, figures, or otherwise described herein are simply exemplary and should not be considered as limiting.

Referring to FIGS. 1-7, a fluid storage tank 2 includes a body 4 extending from a first end 5*a* to a second end 5*b*. The first end 5*a* may include a top wall 6 connected to the body 4. The second end 5*b* may include a bottom wall 8 connected to the body 4. The body 4 may be constructed as one monolithic structure or as several different pieces. In one aspect, the top wall 6 may be constructed from two different panels. The top wall 6 may extend straight across the first end 5*a* of the body 4. Alternatively, the two different panels may be angled relative to one another so that the top wall 6 may be sloped from a middle portion of the top wall 6 down to an outer circumferential edge of the top wall 6. The body 4 may be made from a metallic material, such as steel or aluminum. It is also contemplated that the body 4 may be made from different metallic materials, including additional materials that have a high water corrosion resistance. It is also to be understood that the body 4 may be made from a hard plastic-like material.

Figure 1:
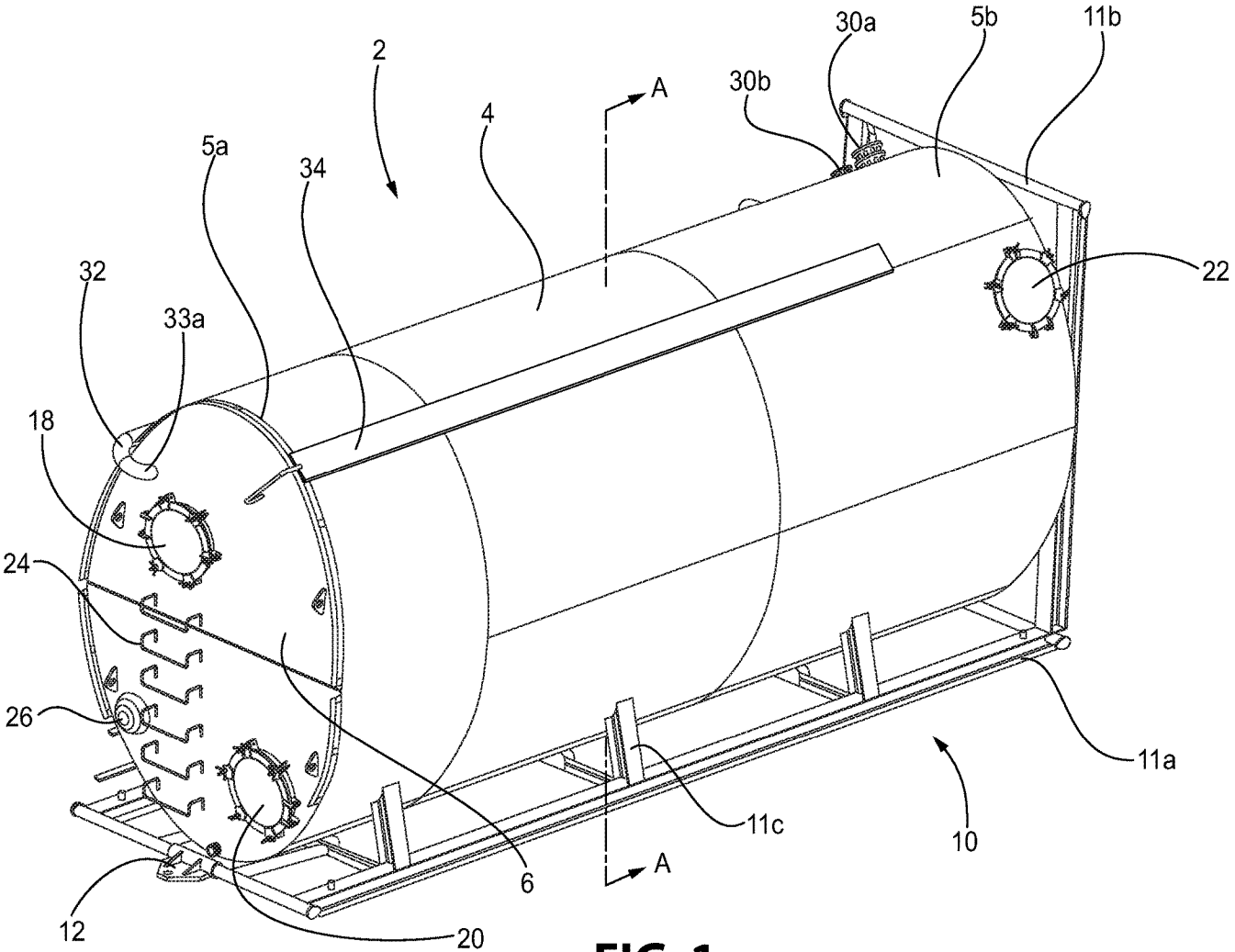
FIG. 1 is a front perspective view of a fluid storage tank in accordance with this disclosure.
Figure 9:
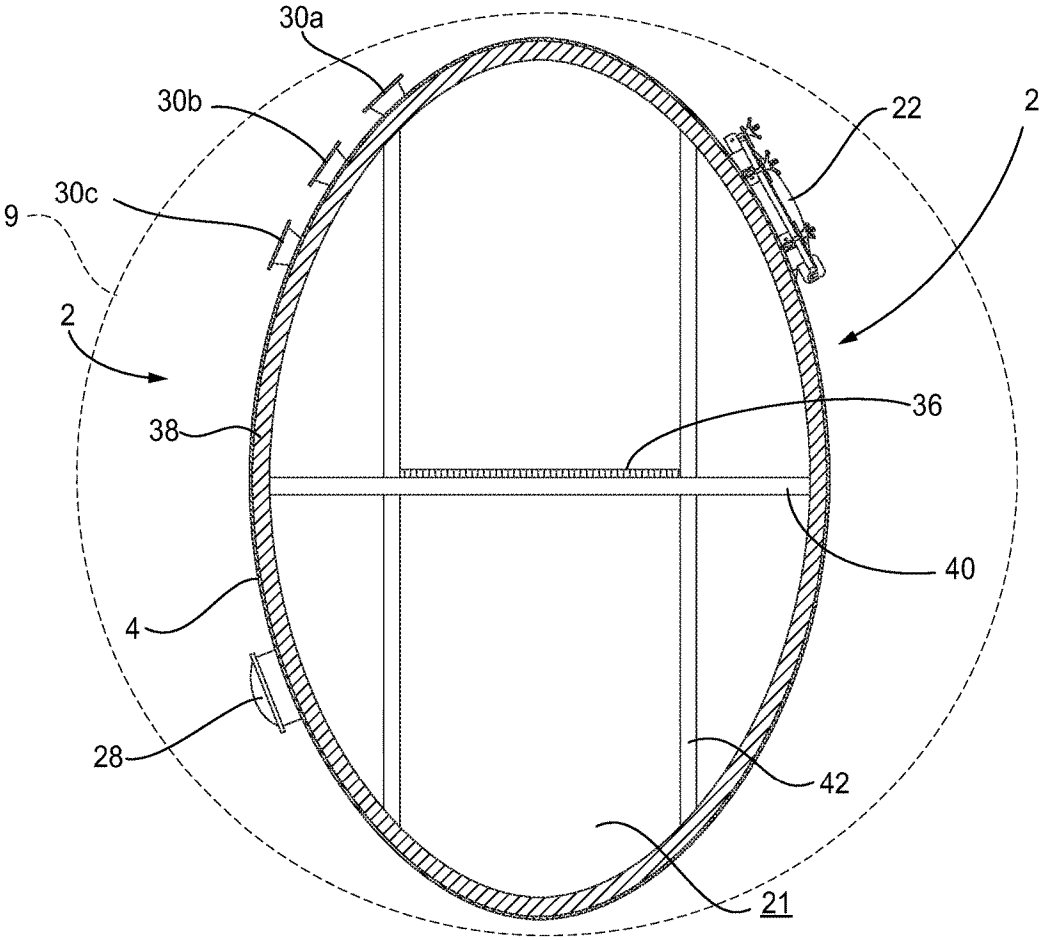
FIG. 9 is a bottom view of the fluid storage tank of FIG. 1 depicting the footprint of the fluid storage tank compared to a pre-existing fluid storage tank.
Figure 10:
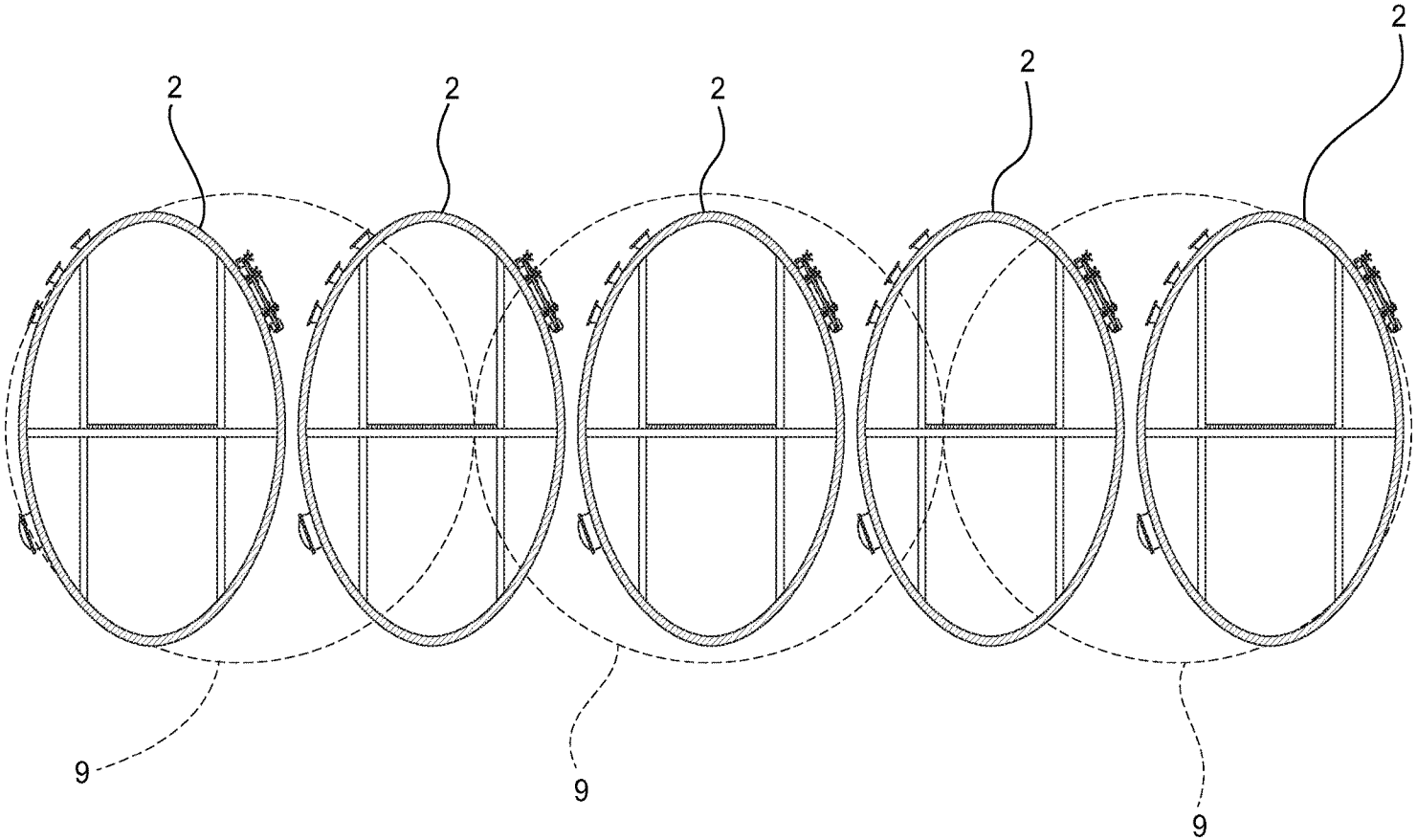
FIG. 10 is a bottom view showing several fluid storage tanks like that of FIG. 1 in comparison to several pre-existing fluid storage tanks.
Figure 11:
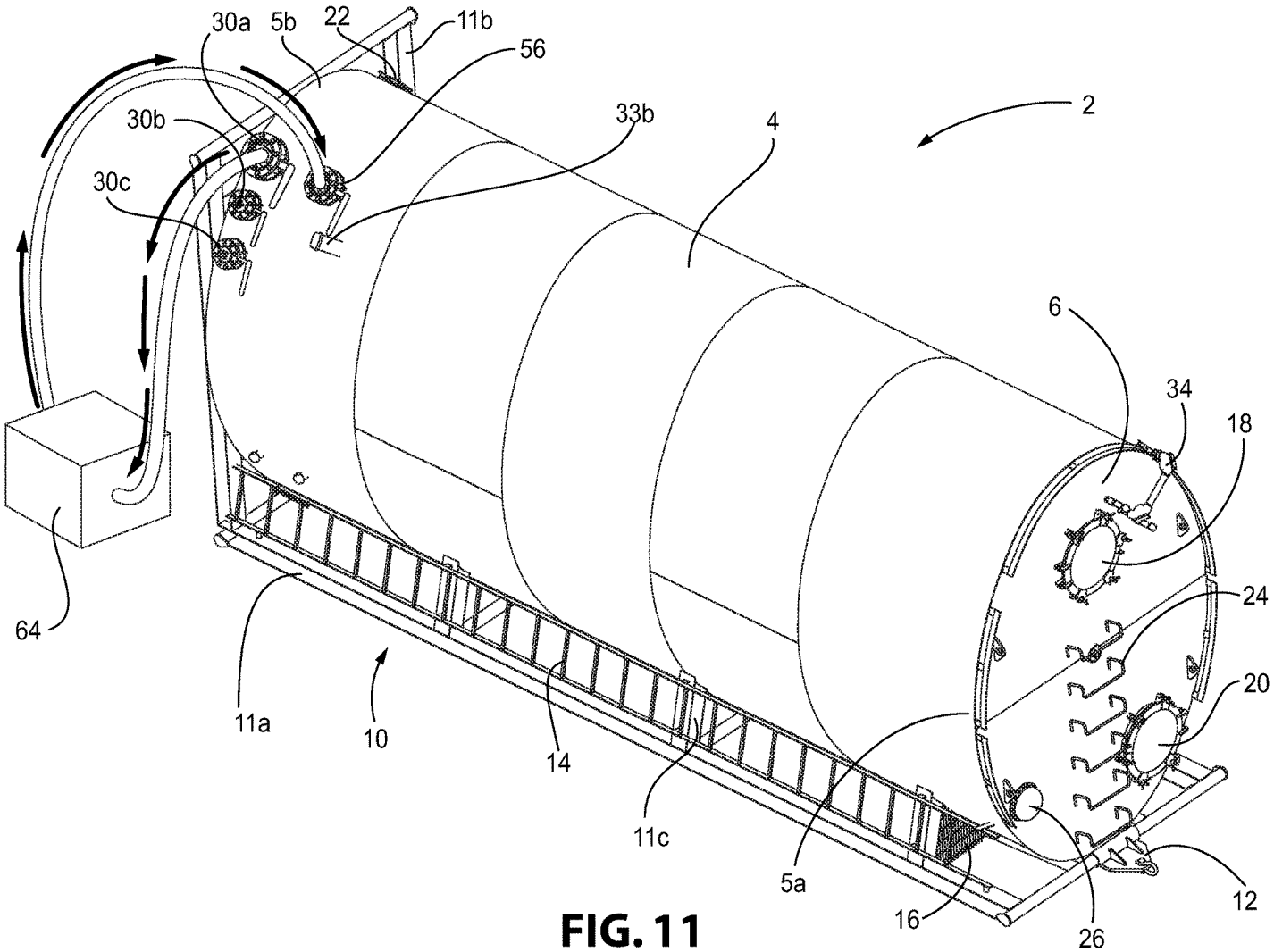
FIG. 11 is a front perspective view of a fluid storage tank in accordance with another aspect of the disclosure.
Figure 12:
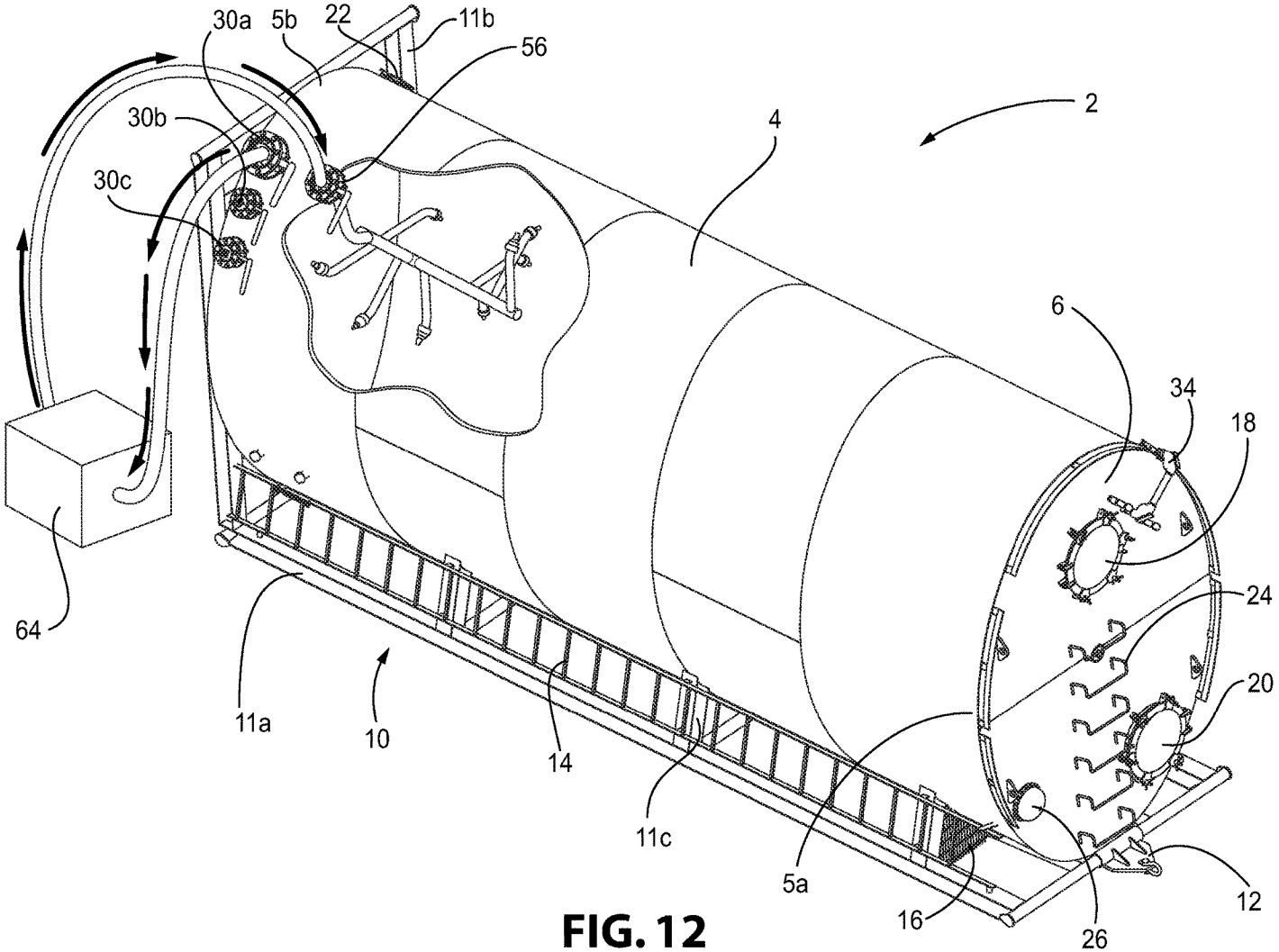
FIG. 12 is a front perspective view of the fluid storage tank of FIG. 11 with a portion of the fluid storage tank removed to show a fluid circulating arrangement housed therein.

The body 4 has a substantially oval cross-sectional shape. By using an oval shape for the cross-section of the body 4, the footprint or amount of space occupied by an end 5*a*, 5*b* of the body 4 is greatly reduced. As shown in FIGS. 9 and 10, the footprint of the oval-shaped body 4 is substantially smaller than the footprint of current circular fluid storage tanks 9. Although the cross-sectional area of the fluid storage tank 2 is smaller than the cross-sectional area of current fluid storage tanks 9, the same volume of fluid may still be stored within the fluid storage tank 2. By increasing the overall longitudinal length of the fluid storage tank 2, the same volume of fluid can be stored within the fluid storage tank 2. It is often an important feature of fluid storage tanks to have a small footprint so as to allow a maximum number of fluid storage tanks to be arranged at a worksite. By using a smaller overall footprint with the fluid storage tank 2, a greater number of fluid storage tanks 2 can be stored at a work site, as shown in FIG. 10. In one aspect, the fluid storage tank 2 may be arranged in a first position in which the fluid storage tank 2 is arranged horizontal to a surface, such as the ground of a work site. An example of this first position is shown in FIG. 1. The fluid storage tank 2 may also be arranged in a second position in which the fluid storage tank 2 is arranged vertical to the surface or ground of the worksite. The fluid storage tank 2 may be positioned in this second position by using winches and cables or chains to pull the fluid storage tank 2 into a vertical position. Alternatively, a crane or similar vehicle (not shown) may be used to arrange the fluid storage tank 2 in the vertical position. It is to be understood that additional methods of arranging the fluid storage tank 2 in a vertical position are contemplated, such as through the use of a pneumatic-cylinder system used with a tractor trailer.

With continuing reference to FIGS. 1-7, a frame member 10 may be connected to the body 4 of the fluid storage tank 2. In one aspect, the frame member 10 may be L-shaped including a first portion 11*a* and a second portion 11*b*. The first portion 11*a* may extend longitudinally along the body 4 and may include support members 11*c* that may be connected to the body 4. The number of support members 11*c* may be adjusted according to the size and volume of the fluid storage tank 2. The second portion 11*b* may be connected to the second end 5*b* of the body 4 and one end of the first portion 11*a* of the frame member 10. The frame member 10 provides support to the body 4 when the fluid storage tank 2 is arranged in either the first horizontal position or the second vertical position. The frame member 10 may be constructed from several pieces of tubing, or may be formed as one monolithic structure. Likewise, when the fluid storage tank 2 is arranged in the second vertical position, the second portion 11*b* may provide support to the body 4. The frame member 10 may also include a coupling mechanism 12 positioned on the first portion 11*a* near the first end 5*a* of the body 4. The coupling mechanism may be used to attach the fluid storage tank 2 to the hitch of a vehicle for transportation to and from a worksite. The coupling mechanism 12 may also be used to anchor the fluid storage tank 2 to the ground or structure when not in use.

Figure 2:
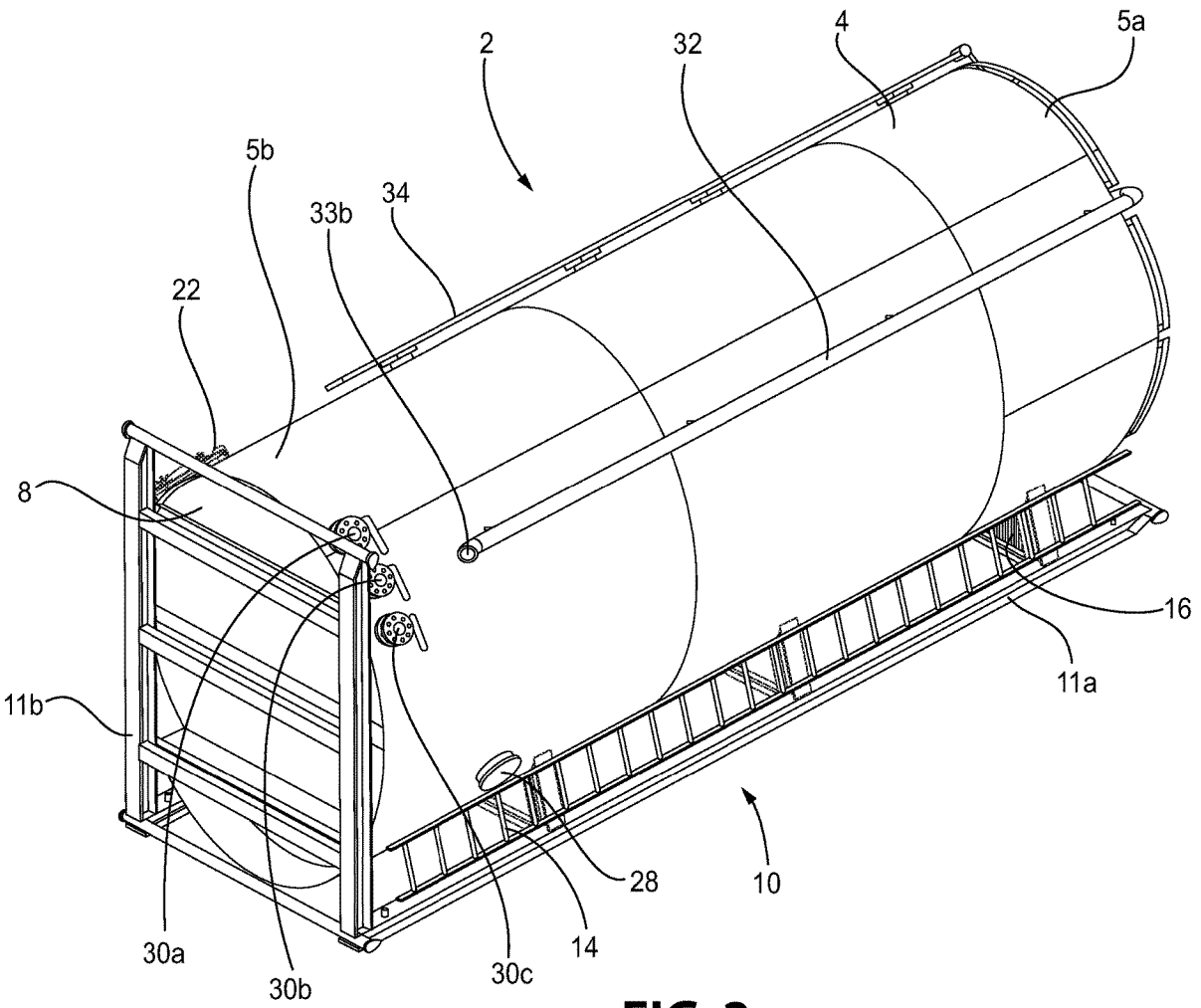
FIG. 2 is a rear perspective view of the fluid storage tank of FIG. 1.
Figure 3:
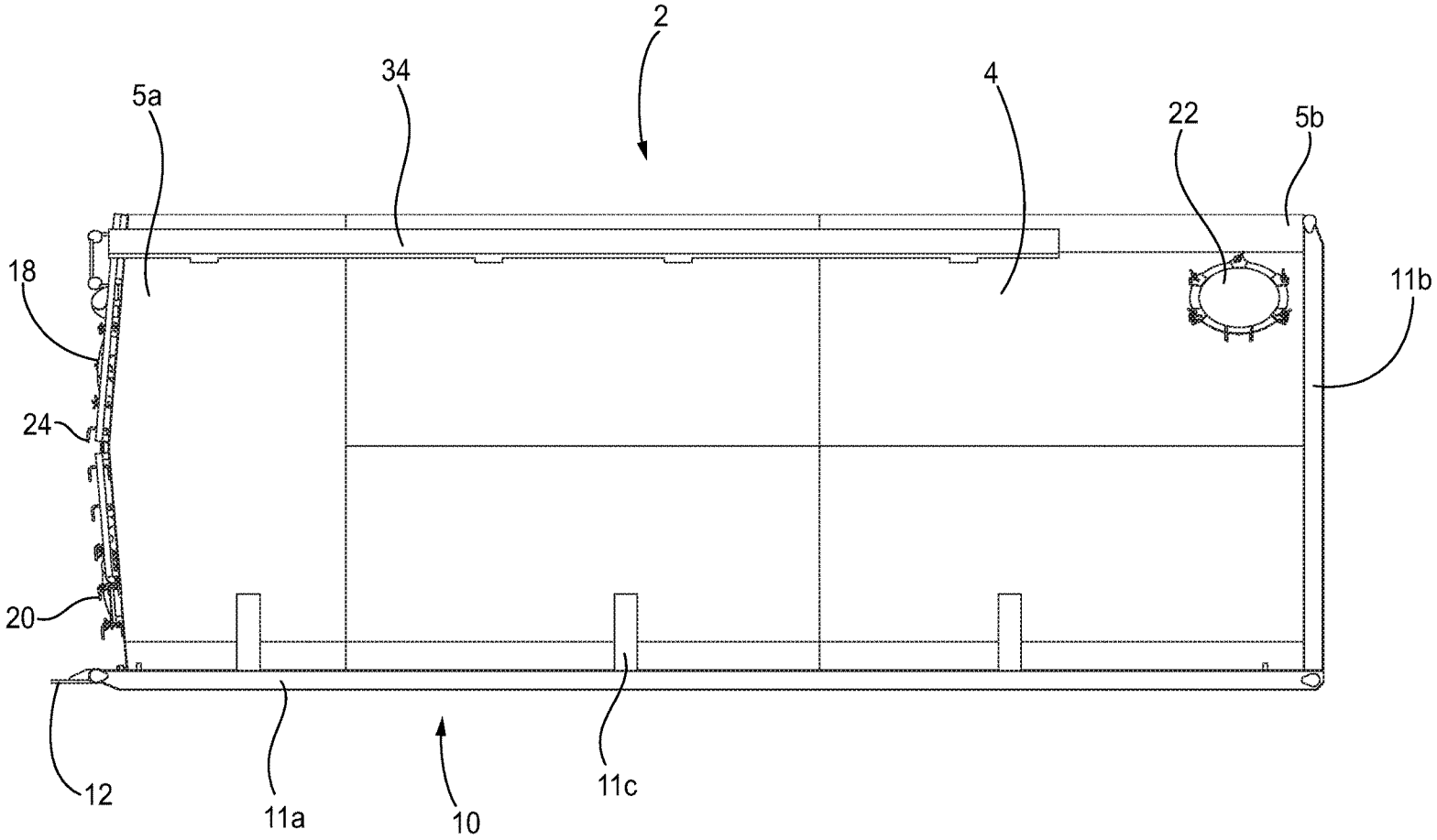
FIG. 3 is a side view of the fluid storage tank of FIG. 1.
Figure 4:
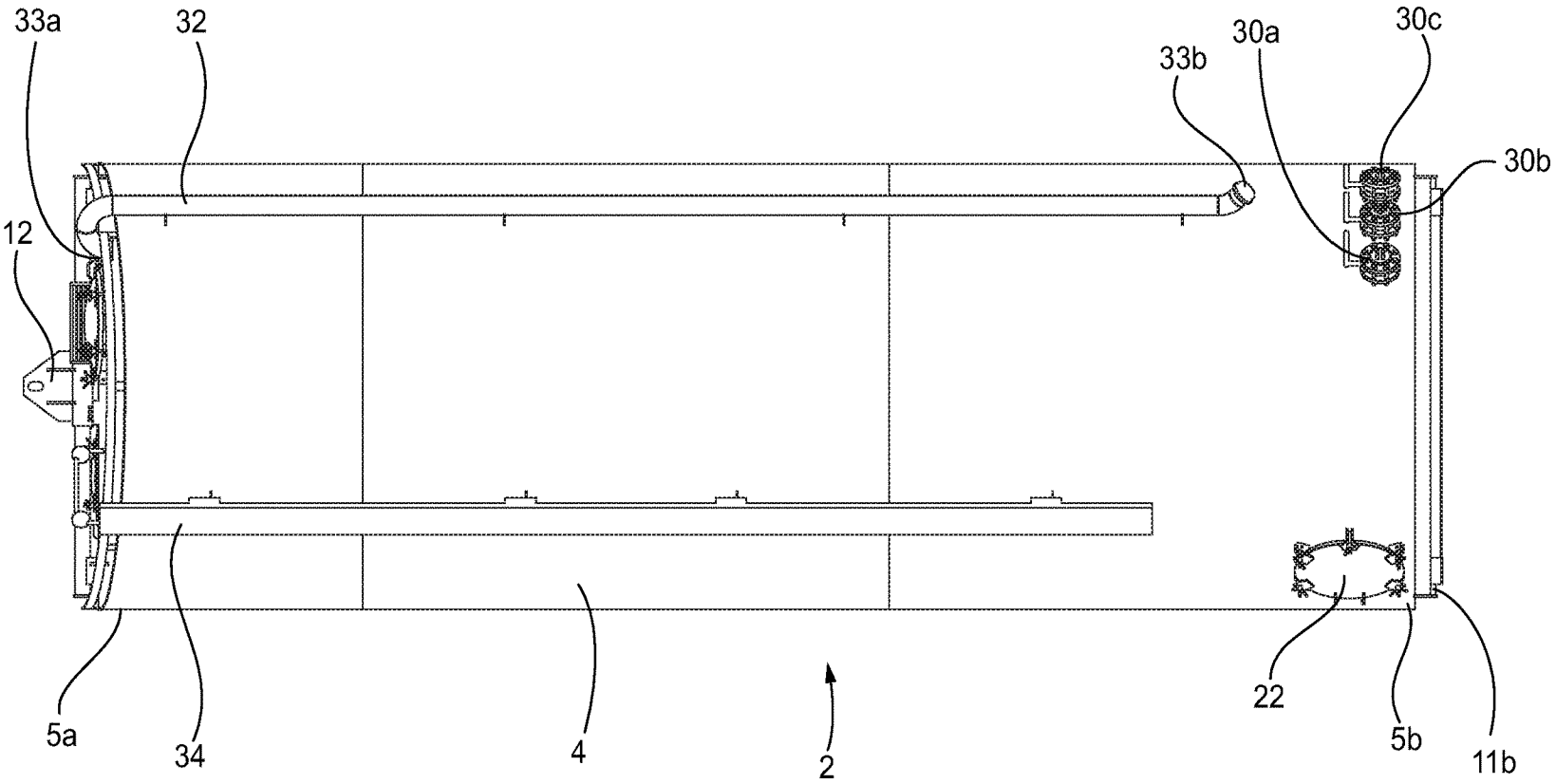
FIG. 4 is another side view of the fluid storage tank of FIG. 1.
Figure 6:
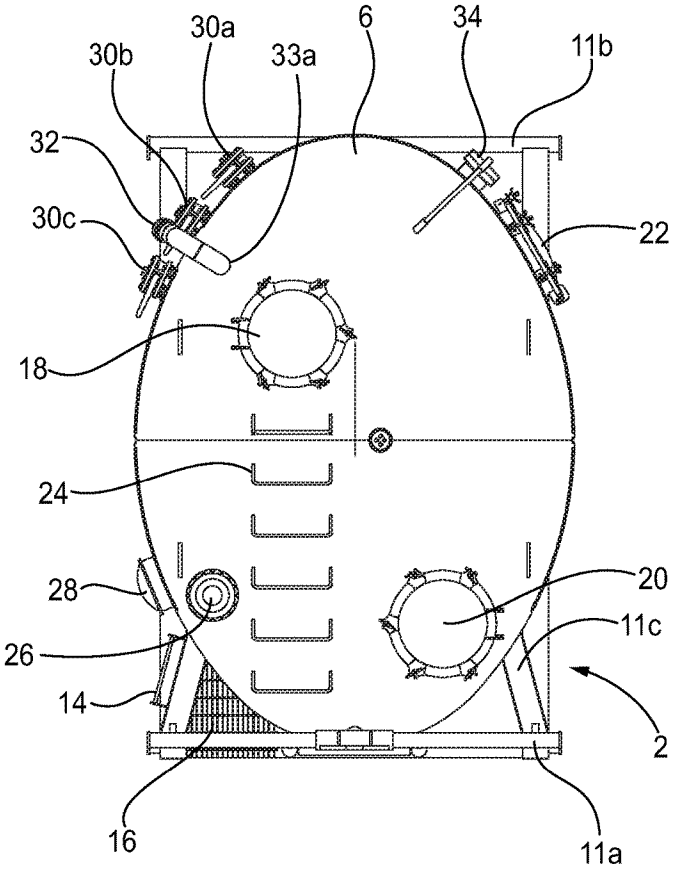
FIG. 6 is a top view of the fluid storage tank of FIG. 1.
Figure 5:
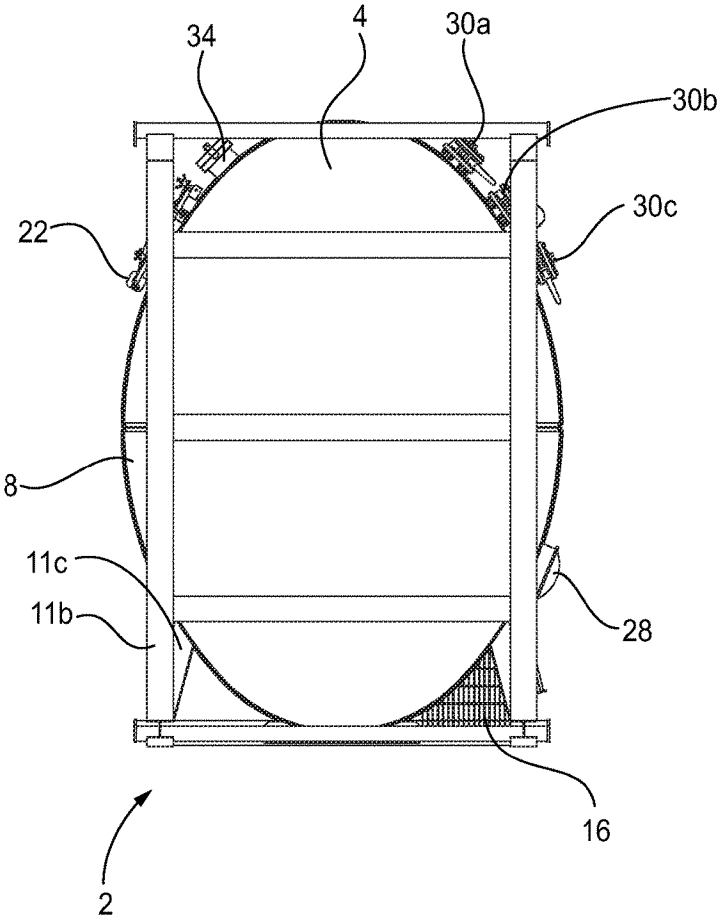
FIG. 5 is a bottom view of the fluid storage tank of FIG. 1.

As shown in FIG. 2, the frame member 10 may also include a ladder 14 and a walkway 16 located on the first portion 11*a* of the frame member 10. The ladder 14 may be attached to the frame member 10 using any well-known fastening arrangement, including welding, fasteners, or forming the ladder 14 as an integral part of the frame member 10. The ladder 14 extends in a longitudinal direction along the body 4 of the fluid storage tank 2 and extends from one end of the first portion 11*a* of the frame member 10 to a second end of the first portion 11*a* of the frame member 10. The walkway 16 may be positioned perpendicular to the ladder 14 and near the first end 5*a* of the body 4. The walkway 16 may extend across the top wall 6 of the fluid storage tank 2. When arranged in the second vertical position, the ladder 14 of the frame member 10 may be used by an individual to climb to the top of the fluid storage tank 2 and stand on the walkway 16. The individual can access an interior cavity 21 of the body 4 by standing on the walkway 16, as will be described in further detail below.

As shown in FIG. 1, the fluid storage tank 2 may also include several access openings 18, 20, 22 that allow an individual to access the interior cavity 21 of the fluid storage tank 2. In one aspect, these access openings 18, 20, 22 are configured as hatches on an exterior surface of the body 4. The access openings 18, 20, 22 may be hingedly attached to the body 4 or may be attached using removable fasteners that can be removed and attached by an individual to open and close the access openings 18, 20, 22. At least two access openings 18, 20 may be positioned on the top wall 6 of the body 4. One access opening 18 may be positioned on an upper portion of the top wall 6, and another access opening 20 may be positioned on a lower portion of the top wall 6. In one aspect, the access openings 18, 20 are positioned opposing one another. Another access opening 22 may be positioned near the second end 5*b* of the body 4. This access opening 22 is positioned on an exterior surface of the body 4 and allows for an individual to access the interior cavity 21 of the body 4. When the fluid storage tank 2 is positioned in the second vertical position, an individual may access the interior cavity 21 of the body 4 via the access opening 22. An individual may access the interior cavity 21 of the body 4 to clean the fluid storage tank 2 or inspect the internal components of the fluid storage tank 2 for stress fractures or wear.

In one aspect, another ladder 24 may be positioned on the top wall 6 of the fluid storage tank 2. The ladder 24 may be fastened to, welded to, or formed integral with the top wall 6. When the fluid storage tank 2 is arranged in the first horizontal position, the ladder 24 allows for an individual to climb up the surface of the top wall 6 and open/close the access opening 18. When in the first horizontal position, the ladder 24 extends from a bottom portion of the top wall 6 to a bottom portion of the access opening 18. A hatch opening 26 may be positioned on the top wall 6 of the fluid storage tank 2. In one aspect, the hatch opening 26 may be positioned adjacent to the ladder 24. The hatch opening 26 may be what is commonly known as a "thief" hatch, which is configured to provide pressure and vacuum relief within the fluid storage tank 2. As shown in FIG. 2, a ventilation opening 28 may be positioned on the second end 5*b* of the body 4 of the fluid storage tank 2. The ventilation opening 28 is configured to provide extra ventilation when drying and/or cleaning the interior of the fluid storage tank 2.

As shown in FIGS. 1, 2, and 4-6, a plurality of discharge valves 30*a*, 30*b*, 30*c* may be positioned on the exterior of the body 4 and may be in fluid communication with the interior cavity 21 of the body 4. The discharge valves 30*a*, 30*b*, 30*c* may be positioned near the second end 5*b* of the body 4. In one aspect, the discharge valves 30*a*, 30*b*, 30*c* may be butterfly-type valves. It is also contemplated that fewer or more discharge valves may be provided on the body 4. It is also contemplated that the discharge valves 30*a*, 30*b*, 30*c* may be provided at different locations on the body 4. The discharge valves 30*a*, 30*b*, 30*c* are configured to be connected to hoses or similar devices used to move the fluid stored in the fluid storage tank 2 to a desired location, such as a fracture well, when arranged in the second vertical position.

As shown in FIG. 2, an inlet pipe 32 may also be connected to the body 4 of the fluid storage tank 2. In one aspect, the inlet pipe 32 may be provided on an exterior surface of the body 4. In another aspect, the inlet pipe 32 may be provided in the interior cavity 21 of the body 4. The inlet pipe 32 may include a first end 33*a* connected to the top wall 6 of the body 4 and a second end 33*b* positioned near the second end 5*b* of the body 4. The first end 33*a* of the inlet pipe 32 may be in fluid communication with the interior cavity 21 of the body 4. The inlet pipe 32 is commonly known as a "downcomer". The inlet pipe 32 may be used to fill the fluid storage tank 2 with fluid via the second end 33*b* of the inlet pipe 32. Fluid communication between an outside fluid source (not shown) and the second end 33*b* of the inlet pipe 32 may be established to fill the fluid storage tank 2. A level indicator 34 may also be positioned on the body 4 of the fluid storage tank 2. The level indicator 34 includes a portion that is connected to an exterior surface of the body 4 and a portion that extends down into the interior cavity 21 of the body 4. Based on the fluid level in the fluid storage tank 2 when arranged in the second vertical position, the level indicator 34 displays the volume of fluid currently stored in the fluid storage tank 2. The first portion of the level indicator 34 positioned on the exterior surface of the body 4 will display the amount of fluid currently housed in the fluid storage tank 2.

Figure 7:
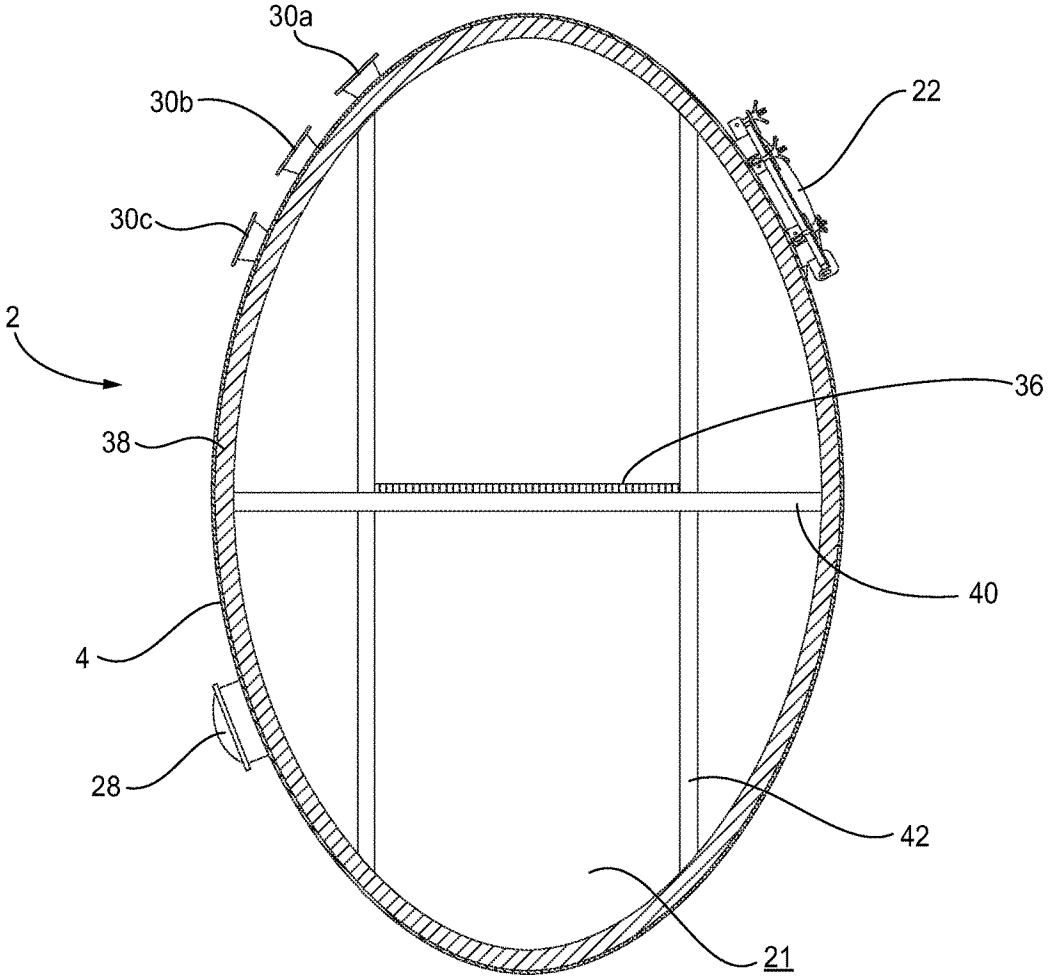
FIG. 7 is a cross-sectional view of the fluid storage tank of FIG. 1 along line A-A.
Figure 8:
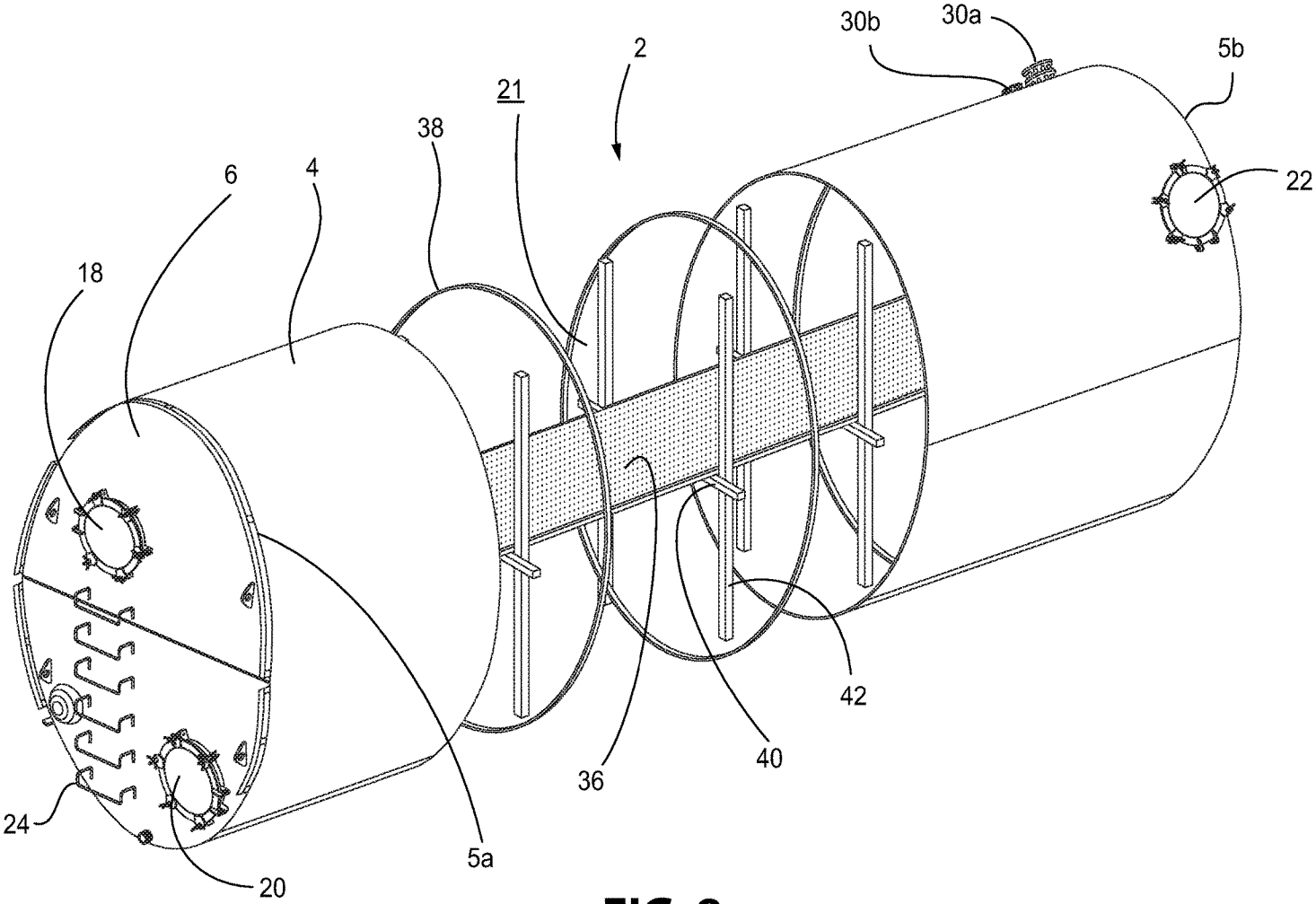
FIG. 8 is a front perspective view of the fluid storage tank of FIG. 1 with a portion of the body of the fluid storage tank removed to show the interior cavity of the fluid storage tank.

With reference to FIGS. 7 and 8, the interior cavity 21 of the body 4 includes several components used to provide added strength and support to the body 4. A walkway 36 may be positioned in the interior cavity 21 of the body 4 and may extend from the first end 5*a* of the body 4 to the second end 5*b* of the body 4. In one aspect, the walkway 36 may be positioned in a substantially centered position within the interior cavity 21 of the body 4. An individual may gain access to the walkway 36 when the fluid storage tank 2 is positioned in the first horizontal position. By entering the interior cavity 21 of the body 4 via the access opening 18, an individual may move along the walkway 36 to inspect the interior cavity 21 of the body 4 and the fluid that is held within the fluid storage tank 2. A top surface of the walkway 36 may be covered with a slip-resistant material so as to assist an individual in walking along the walkway 36, which can often be wet and slippery due to the fluid stored in the fluid storage tank 2. The walkway 36 may be supported by several cross members provided in the interior cavity 21 of the body 4.

With continuing reference to FIGS. 7 and 8, the interior cavity 21 of the body 4 may include several support members used to add stability to the body 4 of the fluid storage tank 2. A plurality of stiffening rings 38 may be positioned along the longitudinal length of the body 4. The stiffening rings 38 form a shape that substantially corresponds to the cross-sectional shape of the body 4. In one aspect, the shape of the stiffening rings 38 may be an oval shape. The stiffening rings 38 may be connected to an interior circumferential surface of the body 4 and provide support to the body 4 when the fluid storage tank 2 is arranged in the first horizontal position. Due to the weight of the fluid stored within, the body 4 may experience a large outward bulging due to the force of the fluid pushing out on the body 4. The stiffening rings 38 may assist in counteracting the large forces created by the stored fluid that is pushing outward on the body 4. The stiffening rings 38 may assist in preventing deformation of the body 4 when fluid is stored therein. It is also contemplated that the stiffening rings 38 may not be included in the body 4 of the fluid storage tank 2. The fluid storage tank 2 may be provided with the requisite strength to withstand the forces described above without the assistance of the stiffening rings 38.

A plurality of tension members 40 may be positioned within the interior cavity 21 of the body 4 to provide added support to the body 4 when the fluid storage tank 2 is filled with fluid. When the fluid storage tank 2 is arranged in the second vertical position, the tension members 40 extend from one side of the body 4 to an opposing second side of the body 4 and are positioned in a parallel plane to the longitudinal axis of the body 4. The tension members 40 may be evenly spaced along the longitudinal length of the body 4 or may be provided in groups according to the specific areas of the body 4 that experience the greatest amount of forces. The tension members 40 may be attached to an inner surface of the body 4. The tension members 40 are configured to counteract the outward forces exerted by the fluid on the body 4 of the fluid storage tank 2. The walkway 36 may be attached to or rest on the tension members 40 in the interior cavity 21 of the body 4. It is also contemplated that the tension members 40 may not be included in the body 4 of the fluid storage tank 2. The fluid storage tank 2 may be provided with the requisite strength to withstand the forces described above without the assistance of the tension members 40.

A plurality of compression members 42 may also be positioned in the interior cavity 21 of the body 4. When the fluid storage tank 2 is arranged in the first horizontal position, the compression members 42 extend from a top portion of the body 4 to an opposing bottom portion of the body 4 and are positioned perpendicular to the longitudinal axis of the body 4. The compression members 42 may be provided evenly along the longitudinal length of the body 4 or may be provided in groups according to the specific areas of the body 4 that experience the greatest amount of forces. The compression members 42 may be attached to an inner surface of the body 4. The compression members 42 are configured to counteract inward forces exerted by the body 4 resting on the ground or worksite surface. In one aspect, the tension members 40 and the compression members 42 may be stiff, rigid beams that are configured to withstand large amounts of pressure. In one aspect, the tension members 40 and the compression members 42 may be comprised of steel or any similar metallic material that is resistant to rusting. It is also contemplated that the compression members 42 may not be included in the body 4 of the fluid storage tank 2. The fluid storage tank 2 may be provided with the requisite strength to withstand the forces described above without the assistance of the compression members 42.

Referring again to FIGS. 9 and 10, the footprint of the fluid storage tank 2 is substantially smaller than the footprint created by pre-existing fluid storage tanks 9. As shown in FIGS. 9 and 10, several more fluid storage tanks 2 may be positioned in a certain pre-defined area as compared to the number of pre-existing fluid storage tanks 9 that include a circular cross-sectional shape. By reducing the footprint of the fluid storage tank 2, more fluid storage tanks 2 may be used at worksites, which allows for more fluid to be supplied to the worksite project.

With reference to FIGS. 11-15, in another aspect of the fluid storage tank 2, the fluid storage tank 2 may not include spacer rings 38, tension members 40, compression members 42, or a walkway 36 within the interior cavity 21 of the body 4. Instead, a fluid circulating arrangement 50 may be provided in the interior cavity 21 of the body 4 to create a swirling effect within the fluid stored in the fluid storage tank 2. The components of the fluid circulating arrangement 50 (described below) may be made from hollow piping that permits the flow of fluid therethrough so the fluid circulating arrangement 50 may induce a swirling effect in the fluid storage tank 2. The fluid circulating arrangement 50 may be suspended within the fluid stored in the fluid storage tank 2 or the fluid circulating arrangement 50 may rest on the bottom wall 8 of the fluid storage tank 2. The fluid circulating arrangement 50 may include an inlet member 52 with an inlet attachment 54 provided on one end thereof. The inlet attachment 54 may be fluid connected to an inlet valve 56 provided on the body 4 of the fluid storage tank 2. An opposing end of the inlet member 52 may be fluidly connected to a main supply member 58. The main supply member 58 may extend perpendicular to the inlet member 52. A plurality of discharge members 60 may be fluidly connected to the main supply member 58. The discharge members 60 may extend perpendicular to the main supply member 58. In one aspect, only one discharge member 60 may be provided on the main supply member 58. In another aspect, at least two discharge members 60 may be provided on the main supply member 58. In a further aspect, seven discharge members 60 may be provided on the main supply member 58. A nozzle 62 may be provided on the end of each discharge member 60 that is opposite from the end of the discharge member 60 that is fluidly connected to the main supply member 58. The discharge members 60 may be positioned along the longitudinal length of the main supply member 58. The discharge members 60 may be evenly spaced apart from one another. Alternatively, the discharge members 60 may be positioned in groups along the longitudinal length of the main supply member 58.

Figure 13:
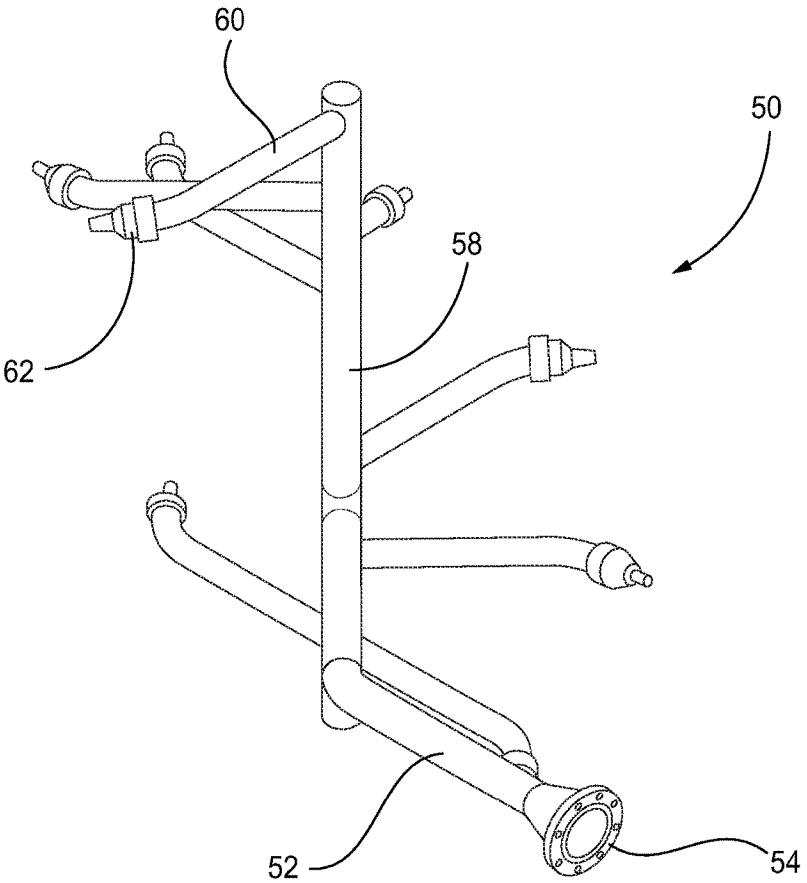
FIG. 13 is a front perspective view of the fluid circulating arrangement of FIG. 12.
Figure 15:
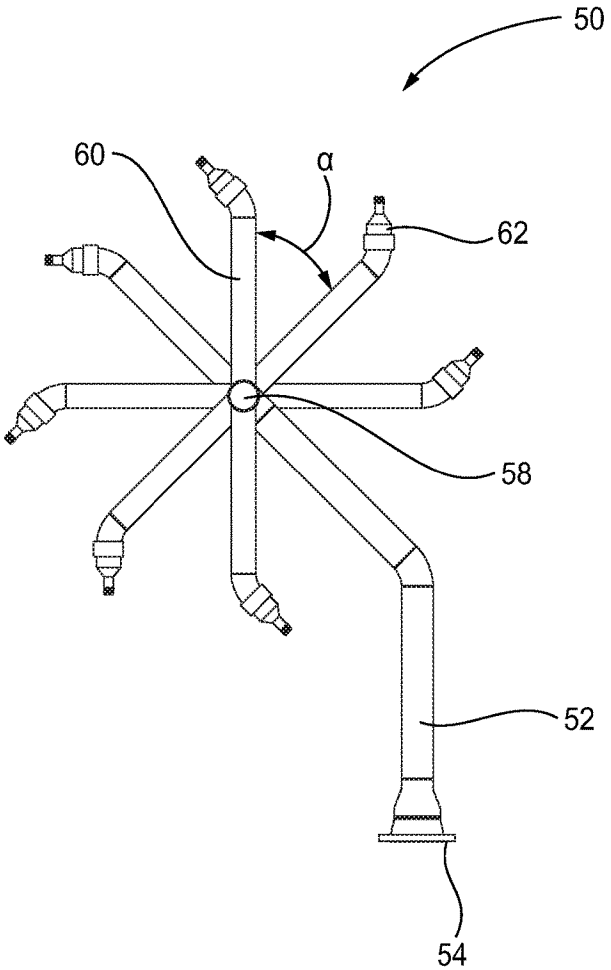
FIG. 15 is a top view of the fluid circulating arrangement of FIG. 12.
Figure 14:
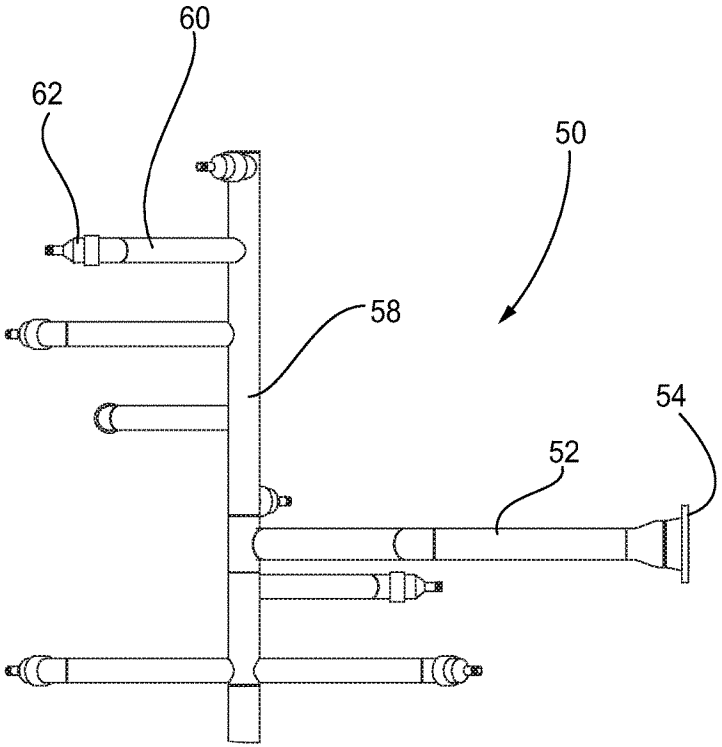
FIG. 14 is a side view of the fluid circulating arrangement of FIG. 12.

As shown in FIGS. 13-15, the discharge members 60 may be positioned at different locations around the circumferential outer surface of the main supply member 58. In this arrangement, the discharge members 60 are spaced at an angle $\alpha$ from one another. In one aspect, a first discharge member 60 may be positioned below a second discharge member 60. The second discharge member 60 may be positioned on the circumferential outer surface of the main supply member 58 at an angle α relative to the lower first discharge member 60. In one aspect, the angle α may be 45 degrees. It is also contemplated that alternative angle degrees may be used with the fluid circulating arrangement 50. It is also further contemplated that each discharge member 60 may be separated by a different angle of degree. In this manner, the discharge members 60 are positioned at an angle to one another. By providing this type of arrangement 50, the fluid stored inside of the fluid storage tank 2 may be circulated using the fluid discharged from the discharge members 60.

During use of the fluid circulating arrangement 50, fluid from the interior cavity 21 of the fluid storage tank 2 is drawn out of the interior cavity 21 via a discharge valve 30*a*. An external pump 64 may draw the fluid out through the discharge valve 30*a* and pump the fluid back into the fluid circulating arrangement 50 via inlet valve 56. The fluid is directed through the inlet member 52 and into the main supply member 58. Once the fluid is directed into the main supply member 58, the fluid is directed to the individual discharge members 60. Subsequently, the fluid is discharged from the nozzles 62 of the discharge members 60 to circulate the fluid stored in the fluid storage tank 2. Based on the angled arrangement of the discharge members 60, the discharged fluid may create a swirling effect within the fluid storage tank 2 so as to keep the stored fluid in constant motion. This swirling effect may cause the stored fluid to circulate in a substantially circular path around the interior cavity 21 of the body 4. By continually circulating the stored fluid, the fluid is prevented from drying out or settling, which is undesirable for situations in which the fluid is mud or slurry that is easily capable of drying out within the fluid storage tank 2.

While aspects of a fluid storage tank 2 are shown in the accompanying figures and described hereinabove in detail, other aspects will be apparent to, and readily made by, those skilled in the art without departing from the scope and spirit of the invention. Accordingly, the foregoing description is intended to be illustrative rather than restrictive. The invention described hereinabove is defined by the appended claims and all changes to the invention that fall within the meaning and the range of equivalency of the claims are to be embraced within their scope.

The invention claimed is:

1. A vertical fluid storage tank, comprising:

a body extending from a first end to a second end defining an interior cavity and having an oval-shaped cross-section;

a top wall connected to the first end of the body;

a bottom wall connected to the second end of the body; and a frame member connected to an exterior surface of the body, the frame member including a first portion that extends longitudinally along the body and a second portion that extends along the bottom wall and is connected to the first portion such that the bottom wall of the body is located on the second portion of the frame member, wherein the fluid storage tank is configured to be arranged in at least two positions, the at least two positions comprising a first position in which the fluid storage tank is arranged parallel to a surface, and a second position in which the fluid storage tank is arranged perpendicular to the surface, wherein the frame member remains connected to the fluid storage tank when the fluid storage tank is moved between the at least two positions; and wherein an outermost width of the first portion is less than an outermost width of the bottom wall of the body.

2. The vertical fluid storage tank as claimed in claim 1, the frame member comprising a ladder extending in a longitudinal direction relative to the body.

3. The vertical fluid storage tank as claimed in claim 1, the frame member comprising a walkway extending across the top wall of the storage tank.

4. The vertical fluid storage tank as claimed in claim 1, further comprising a walkway positioned in the interior cavity of the body.

5. The vertical fluid storage tank as claimed in claim 1, wherein the frame member is L-shaped with the first portion extending along the longitudinal length of the body and the second portion extending along the bottom wall of the storage tank.

6. The vertical fluid storage tank as claimed in claim 1, wherein the first portion of the frame is fixedly connected to the body and the second portion is fixedly connected to the body.

7. The vertical fluid storage tank as claimed in claim 1, wherein the oval-shaped cross section is defined by a major diameter and a minor diameter, the major diameter being greater than the minor diameter, and wherein, in the first position, the major diameter extends perpendicular to the surface and the minor diameter extends parallel to the surface.

8. The vertical fluid storage tank as claimed in claim 7, wherein the minor diameter of the cross section of the body is greater than an outermost width of the frame member.

9. The vertical fluid storage tank as claimed in 1, wherein the frame member includes a coupling for attaching the fluid storage tank to a hitch of a vehicle.

10. The vertical fluid storage tank as claimed in 1, wherein the first portion of the frame member is immovably connected to the second portion of the frame member.

11. A vertical fluid storage tank, comprising:

a body extending from a first end to a second end defining an interior cavity and comprising an oval-shaped cross-section;

a top wall connected to the first end of the body;

a bottom wall connected to the second end of the body; and a frame member connected to an exterior surface of the body, the frame member including a first portion that extends longitudinally along the body and a second portion that extends along the bottom wall and is connected to the first portion such that the bottom wall of the body is located on the second portion of the frame member, wherein an outermost width of the first portion is less than an outermost width of the bottom wall of the body, and wherein the fluid storage tank is configured to be arranged in at least two positions comprising a first position in which the fluid storage tank is arranged parallel to a surface, and a second position in which the fluid storage tank is arranged perpendicular to the surface.

12. The vertical fluid storage tank as claimed in claim 11, the frame member comprising a ladder extending in a longitudinal direction relative to the body.

13. The vertical fluid storage tank as claimed in claim 11, the frame member comprising a walkway extending across the top wall of the storage tank.

14. The vertical fluid storage tank as claimed in claim 11, further comprising a walkway positioned in the interior cavity of the body.

15. The vertical fluid storage tank as claimed in claim 11, wherein the frame member is L-shaped with the first portion extending along the longitudinal length of the body and the second portion extending along the bottom wall of the storage tank.

16. The vertical fluid storage tank as claimed in claim 11, wherein the first portion of the frame is fixedly connected to the body and the second portion is fixedly connected to the body.

17. The vertical fluid storage tank as claimed in claim 11, wherein the oval-shaped cross section is defined by a major diameter and a minor diameter, the major diameter being greater than the minor diameter, and wherein, in the first position, the major diameter extends perpendicular to the surface and the minor diameter extends parallel to the surface.

18. The vertical fluid storage tank as claimed in claim 17, wherein the minor diameter of the cross section of the body is greater than an outermost width of the frame member.

19. The vertical fluid storage tank as claimed in 11, wherein the frame member includes a coupling for attaching the fluid storage tank to a hitch of a vehicle.

20. The vertical fluid storage tank as claimed in 11, wherein the first portion of the frame member is immovably connected to the second portion of the frame member.

* * * * *